United States Patent [19]

Rinard et al.

[11] 4,431,434

[45] Feb. 14, 1984

[54] ELECTROSTATIC PRECIPITATOR USING A TEMPERATURE CONTROLLED ELECTRODE COLLECTOR

[75] Inventors: George A. Rinard, Denver; Michael D. Durham, Englewood, both of Colo.

[73] Assignee: University of Denver, Colorado Seminary, Denver, Colo.

[21] Appl. No.: 241,074

[22] Filed: Mar. 6, 1981

[51] Int. Cl.[3] ..... B03C 3/01

[52] U.S. Cl. ..... 55/135; 55/138; 55/151

[58] Field of Search ..... 55/4, 5, 11, 106, 105, 55/135–138, 150–153, 157; 361/226

[56] References Cited

U.S. PATENT DOCUMENTS

| | | | |
|---|---|---|---|
| 1,357,466 | 11/1920 | Moller | 55/138 |
| 1,358,031 | 11/1920 | Smith | 55/2 |
| 3,026,964 | 3/1962 | Penney | 55/137 |
| 3,495,379 | 2/1970 | Hall et al. | 55/151 |
| 4,092,134 | 5/1978 | Kikuchi | 55/135 |
| 4,119,415 | 10/1978 | Hayashi et al. | 55/154 |
| 4,209,306 | 6/1980 | Feldman et al. | 55/151 |
| 4,266,948 | 5/1981 | Teague et al. | 55/138 |

FOREIGN PATENT DOCUMENTS

| | | | |
|---|---|---|---|
| 237993 | 5/1959 | Australia | 55/135 |

*Primary Examiner*—Bernard Nozick
*Attorney, Agent, or Firm*—James E. Pittenger

[57] ABSTRACT

An improved electrostatic precipitator for removing high resistivity particles from a gas stream. The precipitator includes a charger section having a plurality of corona electrodes and hollow tubular collector electrodes. These electrodes are arranged in parallel, alternating arrangement in a single plane which is positioned perpendicular to the gas flow. The electrodes are connected to a high voltage electrical source while produces a thin high current electrical field which electrically charges the particles present. A temperature control fluid is passed through the collector electrodes to control the temperature of the particles collected so as to maintain the resistivity of the particles in a range in which back ionization will not occur. Due to the size and geometry of the charger section and the temperature control of the particle layer, an extremely high voltage, high current electrical field can be maintained. A collector section can be provided spaced downstream from the charging section. The collector section has a number of equally spaced, parallel plates which are arranged parallel to the gas flow. Alternating plates are connected across a high voltage electrical source which produces a high strength field between the plates to attract and collect the remaining charged particles in the gas stream.

1 Claim, 3 Drawing Figures

ELECTROSTATIC PRECIPITATOR USING A TEMPERATURE CONTROLLED ELECTRODE COLLECTOR

This invention resulted from work done under Grant No. 806222 with the Environmental Protection Agency and is subject to the terms and provisions of said grant.

BACKGROUND ART

The invention is directed to an electrostatic precipitator for removing entrained particles from a gas stream by passing the particle through an intense high current electric field arranged in a thin plane to quickly electrically charge the particles for collection on a collector electrode. It is more specifically directed to an electrostatic precipitator for efficiently removing dust particles from an air stream by the use of two or more collector stages. The primary stage provides a charger and collector electrode suitably positioned in a plane transverse to the gas flow. The collector electrode include cooling or heating of the electrode to control the resistivity of the dust particles retained on the collector electrode to prevent back ionization in the primary stage to allow a high current electrical field to greatly improve the efficiency of the operation of the precipitator.

The present day electrostatic dust precipitator, in most cases comprises a pair or pairs of electrodes which are strategically placed in the path of an air or gas stream which includes dust particles. The purpose is to remove the dust particles and to prevent their being transported with the gas to be vented through the chimney or stack to the atmosphere. In order to reduce this pollution and efficiently remove the particles from the gas stream the electrodes are positively and negatively charged by a high voltage direct current which is applied between electrodes. In this way, a very strong electric field is generated between the corona discharge electrode which can be a wire and the opposite electrode.

When the gas stream to be treated, which can be smoke or dust laden air, is directed past the space between the charged electrodes, the dust particles in the gas are negatively charged and then attracted to the positively charged dust collecting electrodes. This arrangement has been known for many years to be highly efficient for dust precipitation and is commonly used in power generating plants. In the past it has been a well known practice to use rods or wires as the ionizing electrode and pipes or flat tubes plates as the collector electrode.

The dust particles adhere and collect on the collector electrode and during operation and dust must be periodically removed from the electrodes to retain desired high particle removal efficiency. Various mechanisms have been provided in the past to facilitate the removal of these dust particles, such as by mechanical hammer apparatus which tap or shock the electrode structure to establish vibrations which cause dust particles to fall by gravity to the bottom of the duct. Sometimes it is necessary to temporarily remove the voltage from the electrodes to eliminate the electric field during the dust removal process.

Another method for removing the dust from the collectors has been the use of mechanical scrapers which periodically are moved up and down along the outer surfaces of the collector electrodes causing the electrodes to be physically scraped so as to remove the collected dust from the electrodes. Although the shock or hammer method creates some stress and possible eventual cracking in the electrode structures, it has still been found to be the easiest and simplest way of removing the dust from the collectors. The scraping arrangement requires extensive mechanisms and power units for raising and lowering the scrapers with additional provisions required for maintaining the scraper in contact with the surface of the electrodes during the cleaning process. In some of these precipitators the electrodes are arranged as flat plates so that the scraper will be able to move along an extended flat surface to facilitate the removal. The scrapers have been found to have greater disadvantages which render them less desirable than the shock method for cleaning or removing the dust particles.

It has been well known in the prior art that in order to improve the dust removing capabilities of the precipitator, it is necessary to provide a high current electrical field and still eliminate or prevent the presence of back ionization in the vicinity of the collector electrode. Several methods have been suggested for controlling this phenomena. One of these is the control of the resistivity characteristics of the particles by controlling the temperature of the electrodes. Various arrangements have been suggested for controlling this temperature such as passing a cooling fluid through the electrodes during operation but in most cases, this required a considerable amount of cooling or heating capacity required to efficiently maintain the temperature control of the collectors because of the rather large cross-sectional areas required for the electrodes. Until recently the requirements for capacity in the cooling or heating of the electrodes have necessarily limited the use of this method to small air conditioning systems and experimental use. Temperature control has now come into more widespread use and is now being found to provide the desired control for the collector electrodes.

The present invention provides a new and unique arrangement for greatly reducing the size of the electrodes and thus the quantity of cooling or heating fluid required to provide the necessary control of the resistivity of the dust particles. The cost and size of the auxiliary equipment required for operation of the present precipitator can be greatly reduced and provide a substantial improvement in the electrostatic precipitator according to the present invention. In addition, it has been found that by the use of the present electrode geometry and structure the collector electrodes can still be rapped or hammered in the conventional manner without the detrimental effects found in the larger sized units.

The small size of the unit not only reduces the cost and capital equipment requirements but it also represents the optimum design for heat transfer (cooling) of the particles. The warmest area of collected particles in the charging section will have the highest resistivity and will limit the operating voltage. The effectiveness of the system will depend upon how well the collected particles are cooled. Therefore, it is necessary to eliminate any fins or extending surfaces from the electrodes where particles will collect and not be cooled sufficiently.

SUMMARY OF THE INVENTION

The operation of the conventional electrostatic precipitators when collecting high resistivity dust is greatly impaired by back ionization. Back ionization is caused by excessive fields produced in the high resistivity particle layer by the corona current. This causes the dust layer to break down and produce stable back ionization at lower than normal operating voltages for the precipitator. Back ionization also produces ions of opposite polarity than those produced by the corona electrode which has further deleterious effect.

The present invention is directed to improving precipitator performance when collecting high resistivity dust. The improved precipitator according to the present invention utilizes a thin plane charging and possibly additional collector stages. The first stage of this device is designed primarily to charge the dust particles. The structure provided herein is rather thin compared to the conventional electrostatic precipitator and allows a high electric field strength and high corona current densities to be maintained. The charger is designed to operate without producing back corona or ionization. This is accomplished in the present device by cooling or heating the collector electrodes to control the electrical resistivity of the dust surrounding the electrode surface to a value range at which back ionization cannot possibly occur.

The second or collector stage of the precipitator according to the present invention is designed primarily for collecting the charged dust particles. High collection efficiencies in this stage requires an extremely high voltage electric field. In order to produce these field strengths without producing back ionization a number of flat plates arranged in parallel position and parallel to the flow of the gas stream are provided. Every other plate is grounded electrically while the remaining plates are electrically connected to a high voltage potential. In order to eliminate possible corona discharge and improve the collection efficiency which is possible with the higher voltages the collector plates are provided with corona shields which are thin tubes welded along the outside edges of the plates to prevent any possible sharp breaks or surfaces. Even the corners of the plates and the supporting structure are rounded to prevent sharp edges which can aid in starting corona discharge.

The charger/collector or first section described above can also be called the charging or ionization section. This section can be either used alone or followed by a suitable collector section as described. The charging section includes the corona electrode which can be a rod, tube or wire. In addition, the collector electrode which also is a part of this section is formed from a hollow tube which can have any desired cross-section such as circular, and is designed to have a small cross-sectional area. The purpose for the hollow construction is to permit the passage of heating or cooling fluid medium to aid in eliminating the back ionization by controlling the resistivity of the particles collected on the surface of the electrode. It has been found preferable to align the corona electrode and collector electrode is a plane which is at right angles to the flow of the particle laden gas. Because of the unique thinness of the electrodes this plane is only several inches thick through which the gas particles pass almost instantaneously.

The second section or collector stage with its parallel collector plates are usually arranged with the high voltage charged plates downstream of the first stage corona electrodes with the grounded electrodes positioned downstream of the first stage collector electrodes. In this way, the arrangement is found to provide a high degree of back ionization prevention and, thus the entire precipitator could be operated at considerably higher electrical voltages. In this way, the precipitator according to the present invention demonstrated increased collection efficiency and relatively simple operation.

Although the present electrode arrangement has been found to be desirable, it is also possible that the corona electrode can be positioned upstream of the collector electrode and, thus in a plane parallel to the flow of gas. Similarly, two corona electrodes can be provided, one upstream and one downstream of the collector electrode. By the same token, the corona electrode can exhibit many different configurations such as metal strips, rods, wires, brush or barbed electrodes. The spacing between electrodes also can be varied according to the type of particles and gas flow expected to be encountered.

The collector or second section can be modified in various ways such as by the use of a wire plate collector instead of the flat plate electrodes which have been described. In addition, various arrangements for charging the electrodes can be provided such as the use of a high voltage power supply as described or a pulse-excited power energization system can be utilized. It is intended, however, that the present invention will utilize standard precipitator power supplies and controllers to minimize overall costs and operating maintenance.

BRIEF DESCRIPTION OF THE DRAWINGS

Other features of this invention will appear in the following description and appended claims reference being made to the accompanying drawings forming a part of the specification where like reference characters designate corresponding parts in the views.

DETAILED DESCRIPTION

Figure 1:
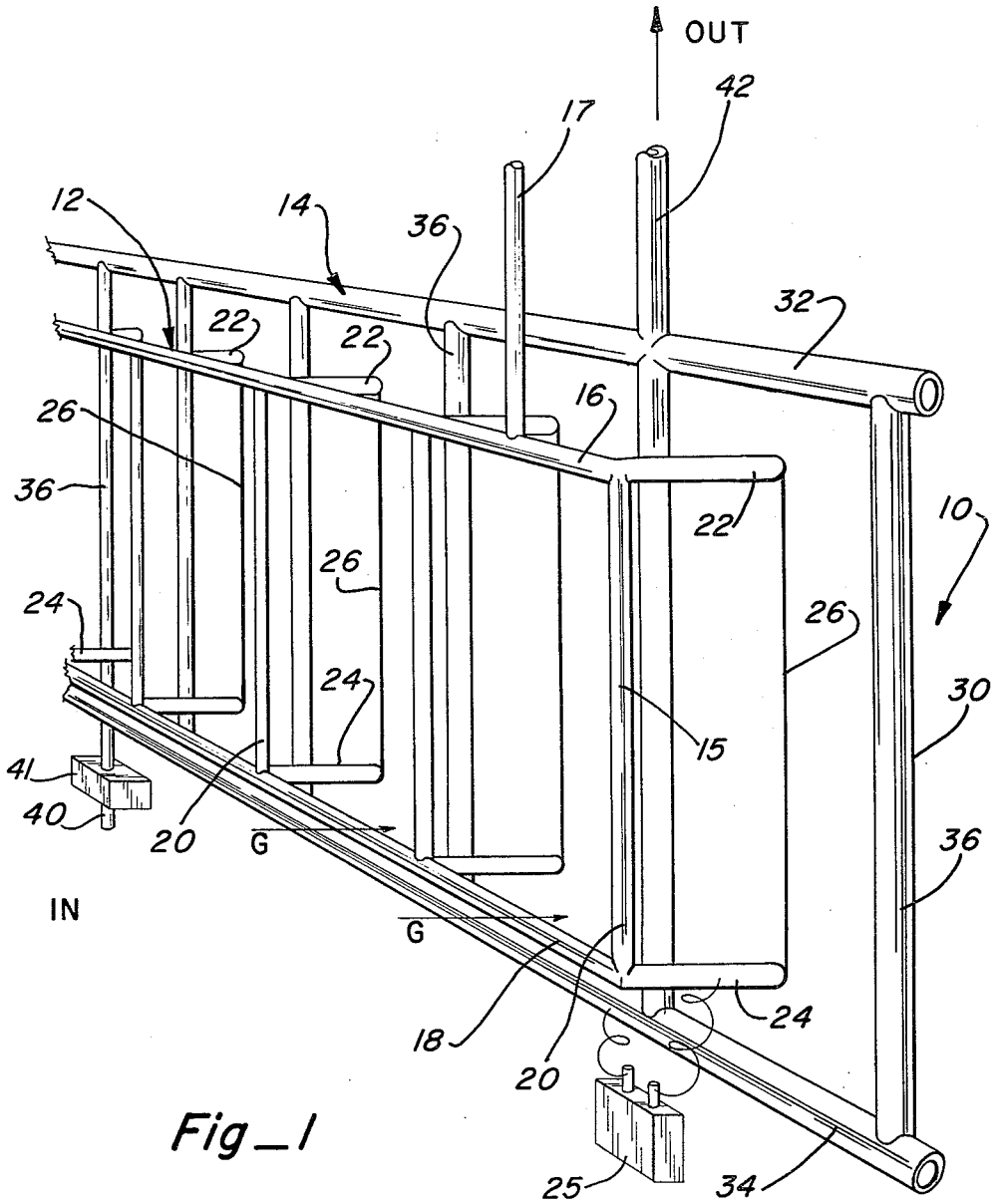
FIG. 1 is a perspective view of the charging section of the precipitator according to the present invention showing the support structures and positioning of the corona and collector electrodes.

Turning now more specifically to the drawings, FIG. 1 shows the charger or ionization section 10 which is mounted in a gas duct or chamber (not shown) which directs the gas flow across the precipitator.

The charger section 10 is made up of the corona electrode assembly 12 and the collector electrode assembly 14. The corona electrode assembly 12 includes the upper support member 16, lower support member 18 and a plurality of innerconnecting, vertical cross members 20. Any number of cross-members may be provided which will obtain the necessary rigidity in the support frame. Arms 22 and 24 are rigidly attached to the upper support member 16 and lower support member 18, respectively, and are arranged to extend outwardly from one side of the support frame. The arms 22, 24 are normally arranged parallel to each other and in a plane which is either perpendicular or angled from the plane of the support frame.

A corona electrode 26 is mounted at the ends of the arms 22, 24 in a taut condition and when electrically connected provides a corona discharge which forms a strong electric field extending radially outward in all directions from the corona electrode 26. Any number of corona electrodes 26 and their supporting arms 22, 24 can be provided along the length of the support frame 15. The actual number and the spacing between the corona electrodes 26 and the length of the wire forming the electrode is dictated by the size of the electrostatic precipitator which is provided.

The collector electrode assembly is made up of the support frame structure 30 which includes upper manifold support 32, lower manifold support 34 and interconnecting vertical conduits 36. The manifolds 32 and 34 and their cross conduits 36 are formed from hollow tubes which are connected together to form a leak tight system to allow complete circulation of fluid throughout the assembly.

Fluid inlet pipe 40 is connected to the lower manifold support member 34 and outlet pipe 42 is connected to the upper manifold support member 32. The inlet pipe 40 and outlet pipe 42 are offset and arranged generally at opposite ends of the support frame 30 so that fluid entering the inlet pipe 40 will traverse the manifolds 32 and 34 and provide even flow distribution upwardly through the interconnecting conduits 36. Baffles can be provided within the manifolds and conduits and various arrangements can be provided to balance the flow throughout the conduits 36 in order to provide relatively even and constant heat transfer across the length of the conduits 36. As will be explained later, the conduits 36 also act as the collector electrodes when the precipitator is operating and provide a collecting surface for the dust particles which are removed from the associated gas.

The positioning of the conduits 36 along the frame 30 is generally equally spaced on either side of the corona electrodes 26. The charger assembly 12 and collector assembly 14 are suitably mounted and supported within the gas duct or flow chamber and are insulated electrically from all other surfaces and each other. Since there will be an extremely high voltage applied across these two assemblies it is necessary to provide adequate electrical insulation at all support points for the assemblies 12 and 14 to prevent any unnecessary arcing and shorting of the power supplies for the precipitator.

In one embodiment of the charger section, the conduits 36 were spaced 9 inches apart with the corona electrodes 26 sandwiched between these electrodes and in the same plane as the collector electrodes 36. In this way, a corona electrode 26 is provided between each pair of collector electrodes. During operation suitably heated or cooled fluid medium is pumped into the inlet 40 and allowed to pass through the collector electrode assembly 14 and discharged through the outlet pipe 42. The fluid used within the electrode assembly 14 can be conditioned by an conventional apparatus such as heaters or chillers so long as they provide the necessary temperatures to control the temperatures of the electrodes 36 and the associated dust particles which are collected thereon. The temperature of the fluid can be controlled by any suitable device such as an electrical or pneumatic control valve 41 which is connected to the fluid inlet pipe 40. The control valve 41 can be in turn connected to an electronic controller which utilizes inputs from one or more sensors to measure the presence of back ionization in order to control the amount of fluid flowing through the manifold assembly.

A suitable high voltage electrical power supply 25 which has a high direct current output is attached between the corona electrodes 26 and the collector electrodes 36. If desired, the entire corona frame assembly 15 can be charged by the high voltage supply relative to the collector assembly 30. So long as these two assemblies are separated sufficiently from each other to prevent arcing and back ionization. There is no need to insulate the elements within the respective assemblies.

In actual use the charging section has been found to be a good charger/collector when used by itself. In the present embodiment the plane of the corona electrodes 26 and collector electrodes 36 are coincidental to each other and are arranged transverse to the flow of gas which is represented by the arrows G.

The dust particles which are transported by the gas flow G are charged by passage through the electric field set up between the corona electrodes 26 and collector electrodes 36. These charged particles are attracted to the collector electrodes 36 where they adhere by their electrical charge to the surface of the electrodes. Since the manifolds 32 and 34 can also have the same potential as the electrodes 36, dust particles will also adhere to these members. Because of the structural design of the charger section an extremely high voltage potential can be provided between the electrodes which forms a very intense, high current electric field with very intense charging of the particles and considerable precipitation of these particles from the gas.

Figure 2:
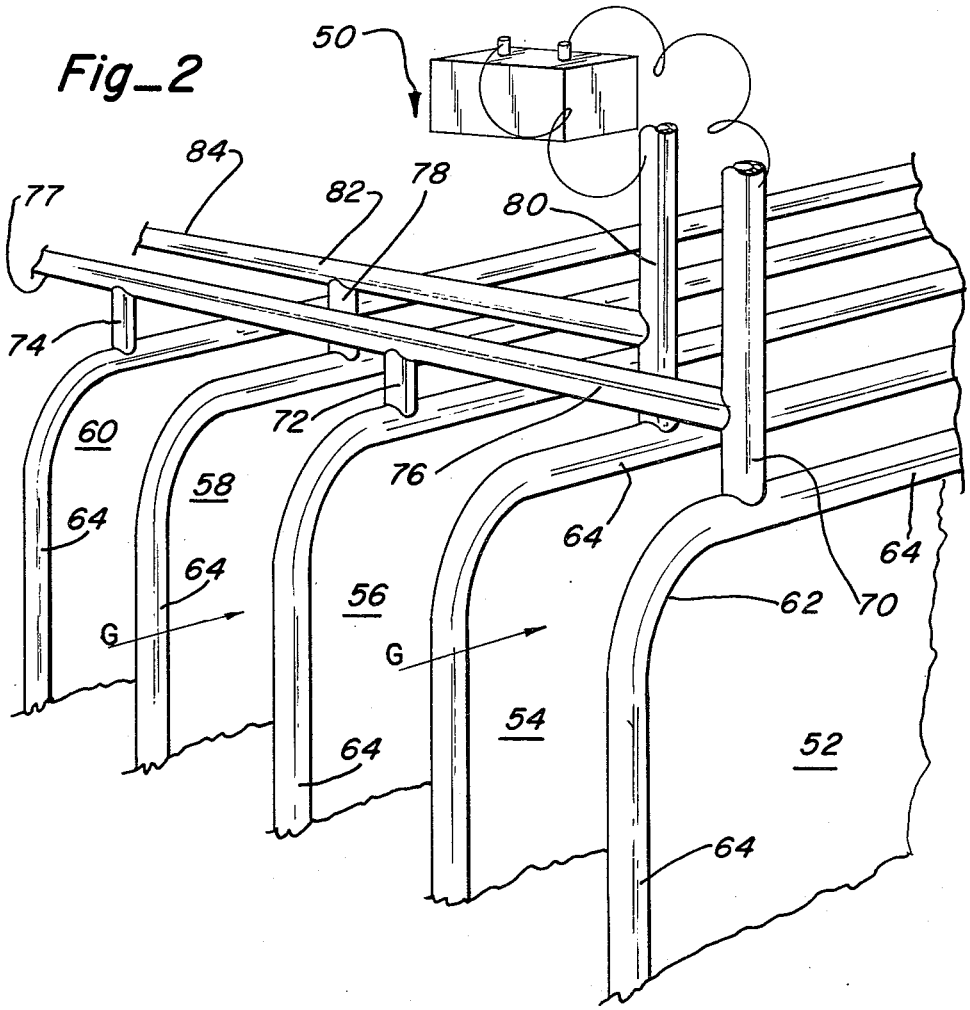
FIG. 2 is a perspective view of the collector section of the precipitator according to the present invention showing the multiple collector plates arranged in parallel position and including corona shields around the outside edges of each collector.

To provide additional collecting capability in the precipitator according to the present invention, a second stage of collectors as shown in FIG. 2 can be provided. The collector section 50 includes a number of thin parallel plates 52, 54, 56, 58 and 60 which are fabricated from metallic sheet material and which are arranged in parallel with each other and parallel to the flow of the particle laden gas. Each of the plates such as plate 52 has rounded corners 62 and a corona shield 64 which is formed as a continuous tube which is permanently attached, such as by welding, around the entire outside perimeter of the collector plate 52. Each of the other collector plates 54, 56, 58 and 60 are formed in the same way and are protected by the corona shield 64 as described for the collector 52. Alternating collectors 52, 56 and 60 form a first set of collector plates and are supported by columns 70, 72 and 74 which are permanently attached to a support cross member 76. A number of the cross support members 76 can be longitudinally spaced along the length of the collectors forming a rigid collector assembly 77 which can be suspended by the upwardly extending legs 70 to the housing or structure of the gas duct. By the same token, the remaining alternating collector plates 54, 58 form a second set of collector plates and are interconnected by legs 78 and 80 and cross member 82 to form a separate collector plate assembly 84.

For electrostatic operation either the collector plate assembly 77 or 84 is electrically isolated from the surrounding structure and the other assembly by means of electrical insulators through which the suspension legs are attached. It is to be understood that any type of support or suspension can be provided for the individual collector plate assemblies which will hold the collector plates in a rigid stationary position with respect to each other and the surrounding structure.

Figure 3:
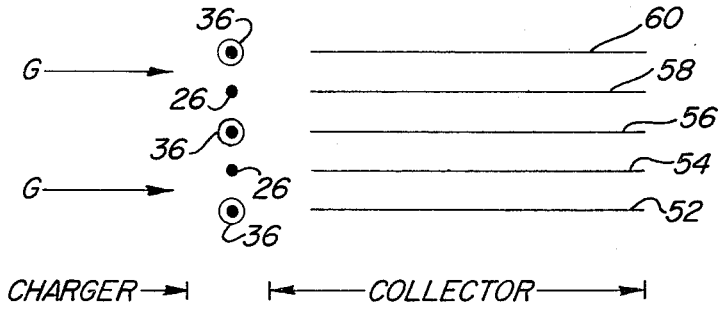
FIG. 3 is a pictoral view of the combined layout of the charger and collector sections of the present invention.

In the illustration provided in FIGS. 2 and 3, it is assumed that the collector plate assembly 84 has been electrically isolated from the structure by means of the electrical insulators as previously described. A high voltage, low current, DC power supply 71 is attached between the assembly 77 and 84. Since the high potential is applied to the assembly 84 the remaining assembly 77 can be connected to a suitable electrical ground to ascertain that its potential is the same as the rest of the surrounding structure. There still remains a considerable high voltage potential between the two plate assemblies which creates a high strength electrical field between the plates.

It is to be understood that any number of collector plate assemblies can be provided as an alternate embodiment to the present configuration so long as it is compatible with the electrode arrangements which are provided in the charger/collector section. It is also intended that the high voltage potential applied to the collector plate assembly 84 is to be the same or higher than that applied to the collector electrodes 36 provided in the first stage. With the corona shield and arrangement of the collector plates as provided in this embodiment corona discharges and back ionization can be held to an absolute minimum to allow the high strength electric field to efficiently remove the remaining dust particles from the gas stream.

It is also provided in this stage that mechanical hammering or shock device can be applied to the individual high voltage collector plates to vibrate the plates and cause the particles to be dislodged so that they fall from the collector plates and can be removed from the dust.

In the embodiment illustrated in FIG. 3, the collector section was provided with a spacing of $4\frac{1}{2}$ inches between each grounded plate and the adjacent high voltage collector plate. In this way, the spacing of the plates is identical to that provided between the electrodes in the first stage charger/collector section. Each of the high voltage potential collector plates of the second stage can be arranged directly downstream from each of the corona electrodes provided in the first stage. In this way, the grounded collector plates align correspondingly downstream of the collector electrodes. Thus, the high voltage collector plates were found to substantially attract the remaining dust particles which pass through the first stage section performing a highly efficient electrostatic dust precipitation operation.

OPERATING EXAMPLE

In order to prove out the operating parameters and feasibility of the present invention an electrostatic precipitator, as described, was constructed and operated. In the construction of the first stage charger section the collecting electrodes were formed from metallic pipe approximately $2\frac{3}{8}$ inch in diameter. The corona electrodes were formed from steel wire having a diameter of approximately $\frac{1}{8}$ inch. During operation the heating and cooling or the collector electrodes was accomplished by the passage of suitably conditioned water to control the desired temperature of the electrodes.

The charger section was operated under high resistivity dust conditions with the gas flow having a temperature of 300° F. Under these parameters the back ionization was completely eliminated by either heating the collector electrodes to obtain a dust surface temperature of 500°–600° F. or cooling the electrode to create a dust surface temperature of 150°–200° F. High corona current densities between the corona electrodes and the collector electrodes in the order of 0.5–1.0 uA/cm$^2$ and an operating flield strength of 6.5 KV/cm was obtained. It was found that the charger section operated very effectively in providing the desired ionization of the dust particles and the collector electrodes provided a very efficient collection operation. As was expected, continuous operation of the charger required periodic removal of collected dust which was accomplished by rapping the collector electrode manifold by a mechanical hammering process. The high corona electrode voltage was momentarily removed during the rapping process and this greatly assisted in the dislodgement and removal of the dust particles from the surface of the collector electrodes. Since the surface temperature of the collector electrode alters the dust resistivity it is necessary to alter the surface temperatures depending upon the type of dust which is being collected. With some types of dust it may be better to heat the electrodes while others may perform better when cooled.

As described above, the second stage collector plate assemblies were arranged with spacing $4\frac{1}{2}$ inches between plates. The high voltage plates were positioned directly downstream of the first stage corona electrodes. The tubular corona shields which are provided around the entire outside edges of the plates consisted of $1\frac{1}{2}$ inch diameter tubing which was welded in place with all edges ground to prevent any sharp protuberances which could allow a corona discharge. The collector electrode section was operated continuously at 45,000 volts DC under the presence of high resistivity dust at an altitude of 5,000 feet above sea level. With this arrangement collection efficiency for the precipitator of this invention was unexpectedly quite high and increased as the voltage on the plates was increased.

It is to be understood that the arrangement of the first and second stage electrodes and the number of stages which are provided can be modified or changed as desired to provide the most efficient operation and obtain the desired effects. As stated previously, the first stage charger section can be operated by itself with good results. However, the operation can be improved and the efficiency increased by the addition of the second stage plate collector section. Additional repetitious series of the first and second stage can be duplicated downstream in the gas flow as space and cost considerations may permit.

As an alternative, the length of the collector plates which are provided in the second section can be increased as desired. Additional lengthening of the collector plates will improve the collecting ability and the removal of even the most minute dust particles from the gas stream. The limitation here is one of physical size and is primarily determined by the size and length of the gas duct or chamber in which the precipitator is positioned.

It is also to be understood that any desired material such as iron, steel, aluminum or copper can be used for the fabrication of the various electrodes and structural support members provided in this invention. The primary considerations are structural and the adequate conduction of the high voltage electricity to provide the necessary high strength electrical fields.

The improved electrostatic precipitator which is shown and described herein provides a very simple geometry which is easy to interface with conventional precipitator designs which are already in existence. Along with the simple geometry the present invention allows the use of conventional means such as rapping or shock vibration of the physical structure of the precipitator to allow the easy removal of the collected dust. By the same token, the small size of the collecting electrodes which are provided in the present design establishes a very small area of cooling or heating and minimizes any restriction to the gas flow through the duct. Thus, with the present design the precipitator is able to operate at extremely high electrical field strengths of greater than 6 KV/cm which is considerably higher than possible with other standard wire plate designs which are commonly used with high resistivity dust particles. Thus, the efficiency and dust collecting capability of the electrostatic precipitator can be greatly improved and increased by the invention that is described herein.

While an improved two stage electrostatic precipitator has been shown and described in detail in this application, it is obvious that this invention is not to be considered to be limited to the exact form disclosed and that changes in detail and construction of the invention may be made without departing from the spirit thereof.

What is claimed is:

1. An improved electrostatic precipitator for use in a gas stream containing high resistivity particles, said precipitator being arranged within a duct through which said gas stream is flowing, the precipitator comprising:

A. a charging means which contains one or more corona electrodes and one or more collector electrodes, 1. said corona electrodes being mounted on a support frame means which is suitably arranged within said duct,
2. said collector electrodes being mounted on a separate support frame means which is suitably arranged within said duct and is electrically insulated from said corona electrodes, said corona and collector electrodes being arranged parallel and in an alternating equidistant pattern, said electrodes being further arranged in a single plane which is positioned transverse to the gas stream,
3. a high voltage, high current, power means connected between said corona electrodes and said collector electrodes to produce a high current electrical field between said electrodes so that the high resistivity particles will be charged and collected on the surface of the collector electrodes,
4. said collector electrodes being formed from hollow tubes through which a temperature control fluid can pass to vary the temperature of the particles collected on said electrodes, the temperature control fluid being controlled by a control means whereby the temperature of the collected particles are maintained within a required range to prevent back ionization and loss of efficiency within the charging means; and B. a plate collector means formed from a plurality of parallel collector plates which are arranged parallel to the gas stream flow and spaced downstream from said charging means, 1. said parallel collector plates being arranged with alternating plates forming a first set and the remaining plates forming a second set, said first and second set of plates being electrically isolated from each other,
2. a high voltage, low current power means suitably connected between said first and second set of collector plates so that a high voltage electric field is established between the plates so that they attract the particles which have passed through the charging means so that the particles be collected on the collector plates to greatly improve the particle removing efficiency of the electrostatic precipitator, and
3. said collector plates being arranged equidistant from each other and spaced the same as said corona and collector electrodes, said first set of plates being positioned directly downstream of said corona electrodes and having a high voltage potential equal to or greater than said corona electrodes.

* * * * *